US005669485A

United States Patent [19]

Painter et al.

[11] Patent Number: 5,669,485

[45] Date of Patent: Sep. 23, 1997

[54] ROTARY SWITCH KNOB ASSEMBLY WITH INTERSPERSED RADIAL LABELING

[75] Inventors: Paige M. Painter, Bartlett; Martin E. Holmes, Hoffman Estates, both of Ill.

[73] Assignee: Motorola, Inc., Schaumburg, Ill.

[21] Appl. No.: 581,898

[22] Filed: Jan. 2, 1996

[51] Int. Cl.[6] ..... H01H 9/00

[52] U.S. Cl. ..... 200/308; 200/11 R; 200/309; 200/336

[58] Field of Search ..... 200/5 R, 6 R, 200/11 R, 17 R, 43.04, 43.08, 52 R, 308, 309, 310, 312, 313, 316, 317, 336

[56] References Cited

U.S. PATENT DOCUMENTS

| | | | |
|---|---|---|---|
| 3,198,923 | 8/1965 | Tripp | 200/308 |
| 3,384,729 | 5/1968 | Burris et al. | 200/336 |
| 3,446,924 | 5/1969 | Giambertoni | 200/308 |
| 3,575,577 | 4/1971 | Cunnane | 200/17 R |
| 3,636,915 | 1/1972 | Ruppert | 200/308 |
| 3,720,800 | 3/1973 | Arnold | 200/308 |
| 3,767,880 | 10/1973 | Austin | 200/336 |
| 3,988,555 | 10/1976 | Hooper | 200/308 |
| 4,107,500 | 8/1978 | Distler et al. | 200/308 |
| 4,546,219 | 10/1985 | Rose | 200/11 R |
| 5,223,822 | 6/1993 | Stommes et al. | 200/336 |

*Primary Examiner*—Jeffrey L. Sterrett
*Attorney, Agent, or Firm*—Frank M. Scutch, III

[57] ABSTRACT

A rotary switch knob assembly (100) includes one or more circular knobs (101) having a plurality of interspersed labeling configured radially at least partially about the knob. The labeling including a first set of characters (105) and a second set of characters (107) each configured at a predetermined distance and angle between an adjacent character. A viewing window (109) is positioned over the labeling where either the first set of characters (105) or the second set of characters (107) are displayed through the viewing window (109) depending on an angular position of the viewing window.

13 Claims, 2 Drawing Sheets

ROTARY SWITCH KNOB ASSEMBLY WITH INTERSPERSED RADIAL LABELING

TECHNICAL FIELD

This invention relates in general to display indicators used with electronic switches and more specifically knobs used with electronic switches.

BACKGROUND

Many types of electronic switches are used with electronic equipment each varying in size and configuration. One of these types is the rotary switch. This type of switch is very old and well known and commonly used on many electrical and electronic devices. Typically, some type of knob is used in conjunction with the switch in order to determine the switch position. The switch's position can also vary greatly depending on the type of rotary switch used. The benefits associated with the rotary switch are many. Rotary switches are used when switch settings need to be changed more than infrequently and offer the user an easy way to accomplish this task without the need for special tools.

As is also well known, knobs used with rotary switches often use a series of letters or numbers to let the user know the switch's electrical position. A problem arises for the manufacturer since often many different knobs must be made to accommodate the various legends that must be placed on them to be used with different rotary switches. This ultimately increases expense for the manufacturer which translates into increased product cost.

Thus, the need exists for a knob that can be used for one or more rotary switches which includes labeling which can be configured for each individual rotary switch to which it is affixed.

DETAILED DESCRIPTION OF THE PREFERRED EMBODIMENT

Figure 1:
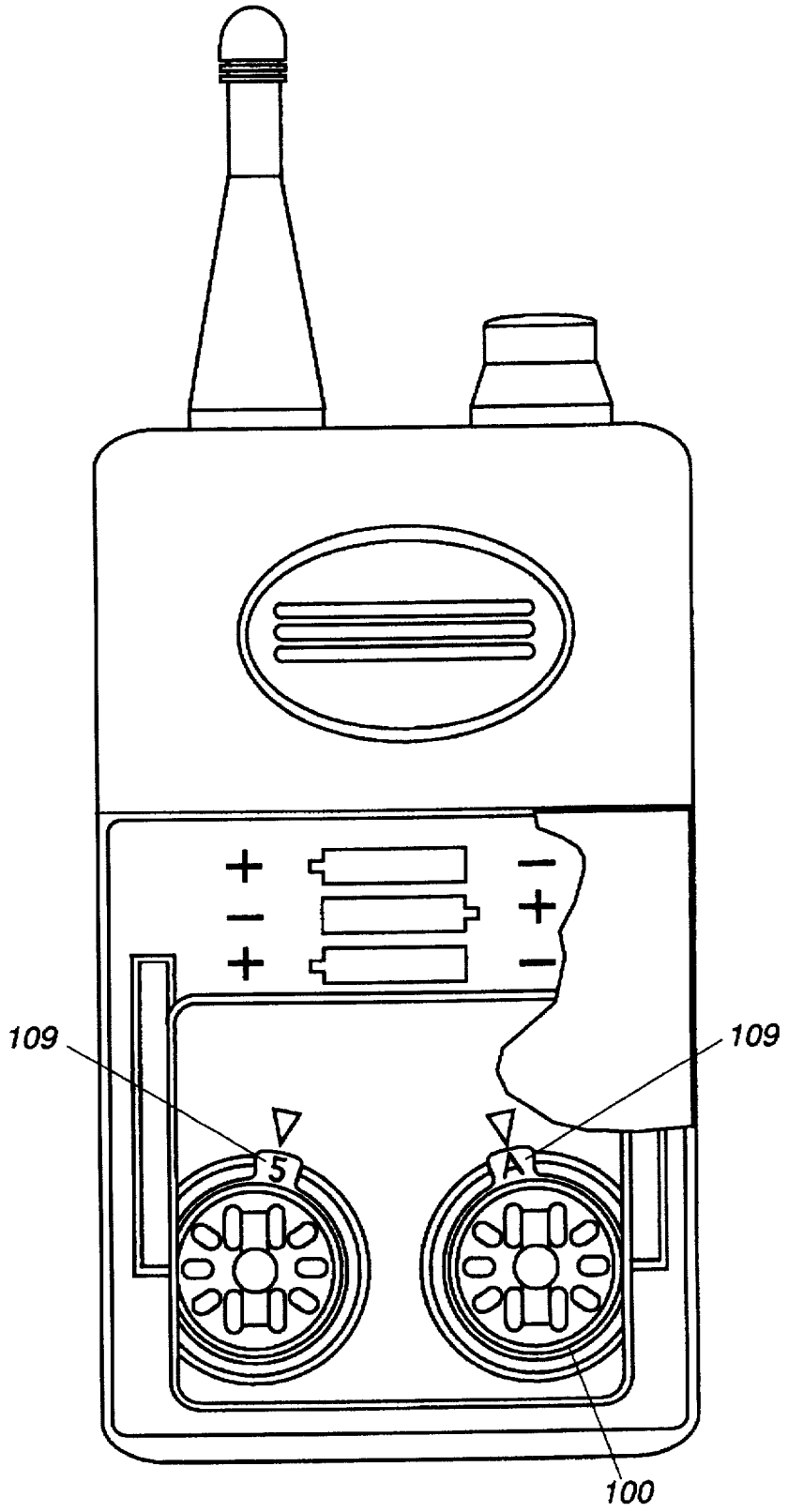
FIG. 1 is a cut-away view of an electronic device showing the rotary switch knob assembly according to a preferred embodiment of the invention.
Figure 2:
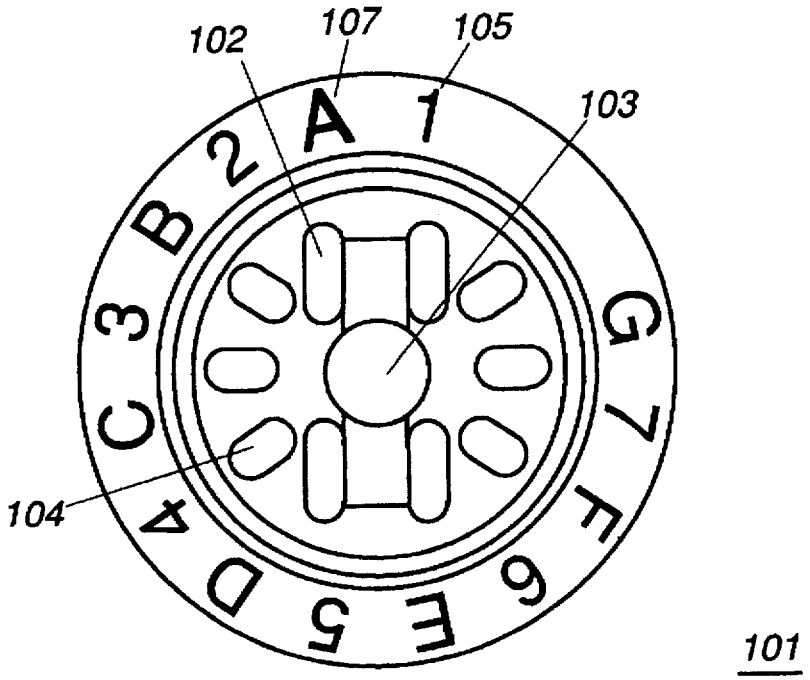
FIG. 2 is a top view of a knob used with the switch knob assembly as shown in FIG. 1.
Figure 3:
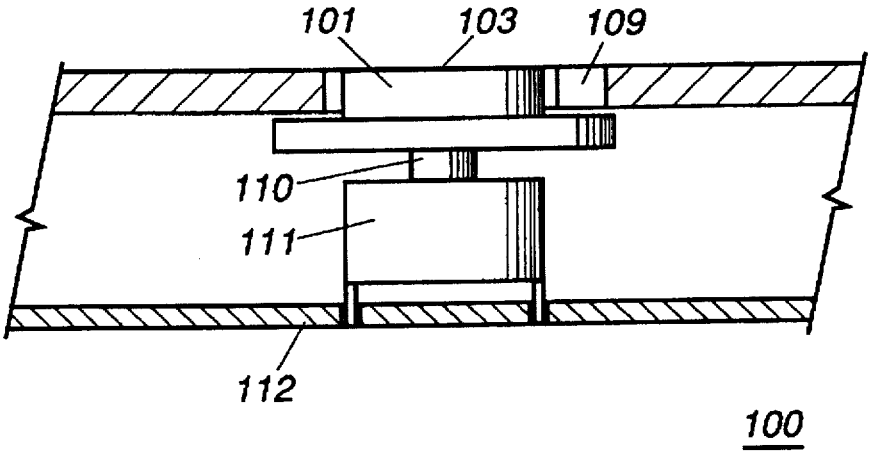
FIG. 3 is a side sectional view of the rotary switch knob assembly as shown in FIG. 1.

Referring now to FIGS. 1, 2 and 3, the rotary switch knob switch apparatus or assembly 100 is shown according to the preferred embodiment of the invention. Although the rotary switch knob assembly 100 is shown as used with a portable two-way radio device, it will be evident to those skilled in the art that the invention can be used with any type of electronic device or circuit which utilizes one or more rotary type electronic switches 111.

The rotary switch knob assembly includes a circular knob 101 which attaches to a shaft 110 of an electronic rotary switch 111. The shaft attaches to the underside of a hub 103. The upper surface of hub 103 is substantially a flat portion or area so the rotary switch knob assembly 100 can be picked up and placed on a printed wiring board using a vacuum nozzle of an automated machine or the like. The knob 101 further includes one or more grip knurls 104 and protrusions 102 which can be used to turn the knob in a circular motion using a coin or other type of tool.

As best seen in FIG. 2, a first set of characters 105 and a second set of characters 107 are positioned or interspersed radially about the outer edge or skirt of the upper surface of the knob 101. Although the first set of characters include the series numbers 1 through 7 and the second set of characters include the series of letters A through G, it will be evident to a skilled artisan that any types or sequence of characters can be used. Thus, as shown in FIG. 2 there are eight characters in each set used in this configuration, one for each rotary switch position.

The first set of characters and the second set of characters are interspersed so to alternate forming the sequence 1, A, 2, B, 3, C, . . . etc. The angular spacing between each of the positions of each set is 45 degrees. The angular spacing is defined as the angle in which a character is printed on the face or skirt of the knob 101 as compared with an adjacent similar character. Thus, the angular spacing between characters 1 and 2 is 45 degrees while the angular spacing between adjacent dissimilar characters is 22.5 degrees.

In operation, a display or viewing window 109 is positioned over the top of the knob 101. The viewing window 109 is a cut-out section and is specifically sized so as only one character on the knob 101 can be seen through the viewing window 109. The viewing window 109 has a specific offset angle and position so as the rotary switch and knob 101 are rotated only characters from the first set or characters from the second set show through the viewing window.

As seen in FIG. 1, the offset angle is 11.25 degrees to the fight of vertical for the left knob displaying "5" and 11.25 degrees to the left of the vertical for the right knob displaying "A". Each corresponding switch position stops directly under the viewing window 109. In this way only characters from one group are displayed since the switch position stops only under the window.

According to a preferred method of the invention, a method of displaying a plurality of groups of characters placed about a circular dial is taught. Each character of the plurality of groups of characters is positioned a predetermined distance and at a predetermined angle from an adjacent character. Each one character of the plurality of groups of characters is alternately displayed on a dial face. The method comprises the steps of positioning a viewing window over the circular dial such that only one character of one of the plurality of groups of characters is displayed through the viewing window. When the circular dial is rotated, only one character of the next successive one of the plurality of groups of characters is displayed through the viewing window.

As will be evident to those skilled in the art, the total number in a set varies depending on the number of positions of the rotary switch. The corresponding angles therefore are also dependent on the number of rotary switch positions. A four position rotary switch, for example, would have an angular spacing of 90 degrees between each character in a set and 45 degrees between characters in adjacent sets.

In short, the present invention is directed to a rotary switch knob assembly which includes one or more knobs having series of characters or labels radially displayed about the knob. The characters alternate between groups and each has a unique angular position with respect to its adjacent characters. A viewing window having a corresponding angular position is laid on top or over the knob. Depending on the angular position of the viewing window, only one set of characters displayed on the knob is displayed when at each rotary switch position. The present invention is efficient allowing a single knob type to be used with a single rotary switch type so differing knobs or knob labeling need not be used.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A rotary switch knob assembly comprising:

a circular knob for attachment to an electronic switch having a plurality of interspersed labeling configured radially at least partially about the knob, the interspersed labeling having a first set of characters and a second set of characters each configured at a predetermined angle;

a first viewing window positioned over the interspersed labeling; and wherein either the first set of characters or the second set of characters are displayed through the viewing window depending on an angular position of the viewing window.

2. A rotary switch knob assembly as in claim 1 further comprising: a plurality of grip knurls fixed to a surface of the circular knob for turning the circular knob with a tool.

3. A rotary switch knob assembly as in claim 2 further comprising a flat portion upon the surface of the circular knob for placement of the knob and switch assembly using a vacuum.

4. A rotary switch knob assembly as in claim 1 wherein the first set of characters are interspersed with the second set of characters.

5. A rotary switch knob assembly as in claim 4 wherein the first set of characters are letters and the second set of characters are numbers.

6. A rotary switch knob assembly as in claim 1 wherein the viewing window is dimensioned approximately the size of one of the first set of characters and the second set of characters.

7. A rotary switch knob assembly as in claim 1 wherein the predetermined angle between a character of the first set of characters and an adjacent character of the second set of characters is 22.5 degrees.

8. A rotary switch knob assembly as in claim 1 wherein the first viewing window is offset at substantially a 22.5 degree angle from a predetermined position such that only one character of the first set of characters or the second set of characters will be displayed through the viewing window.

9. A rotary switch knob display apparatus used with a plurality of rotary switches comprising:

a first knob having a first set of radially displayed characters and a second set of radially displayed character, the first set of radially displayed characters positioned on the knob such that each one alternates and is displayed a predetermined distance from each one of the second set of radially displayed characters;

a second knob having a first set of radially displayed characters and a second set of radially displayed characters, the first set of radially displayed characters positioned on the knob such that each one alternates and is displayed a predetermined distance from each one of the second set of radially displayed characters;

a first display area positioned above the first knob such that only the first set of characters are displayed through the first display area; and a second display area positioned above the second knob such that only the second set of characters are displayed through the second display area.

10. A rotary switch knob display apparatus as in claim 9 wherein the first display area is offset from the second display area by 22.5 degrees.

11. A rotary switch knob display apparatus as in claim 9 wherein the angular spacing between one of the first set of radially displayed characters and an adjacent one of the second set of radially displayed characters is 45 degrees.

12. A rotary switch knob display apparatus as in claim 9 wherein the first knob and the second knob include at least one protruding knurl for rotating the first knob or the second knob using a tool.

13. A method of displaying a plurality of groups of characters placed about a circular dial wherein each character of the plurality of groups of characters is positioned a predetermined distance from an adjacent character and is alternately displayed on a dial face, the method comprising the steps of:

positioning a viewing window over the circular dial such that only one character of one of the plurality of groups of characters is displayed through the viewing window; and rotating the circular dial so a next successive one of the one of the plurality groups of characters is displayed through the viewing window without displaying an adjacent character from another group of the plurality of groups of characters.

* * * * *